US007273386B2

(12) United States Patent
Olson et al.

(10) Patent No.: US 7,273,386 B2
(45) Date of Patent: Sep. 25, 2007

(54) PIN SHROUD

(75) Inventors: Richard E. Olson, Rindge, NH (US); Jill H. Quinn, Atkinson, NH (US); Stacy A. Fraker, Allen, TX (US); Jeffrey L. Deeney, Fort Collins, CO (US); Joseph D. Dutson, Hyde Park, UT (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/901,338

(22) Filed: Jul. 28, 2004

(65) Prior Publication Data

US 2006/0025005 A1 Feb. 2, 2006

(51) Int. Cl.
*H01R 13/62* (2006.01)

(52) U.S. Cl. ..... 439/367

(58) Field of Classification Search ..... 439/367, 439/76.1, 638, 945

See application file for complete search history.

(56) References Cited

U.S. PATENT DOCUMENTS 4,160,503 A 7/1979 Ohlbach
4,173,387 A 11/1979 Zell
4,293,070 A 10/1981 Ohlbach
4,589,718 A 5/1986 Szczesny
4,653,828 A 3/1987 Szczesny et al.
4,761,141 A 8/1988 Hawk et al.
5,176,526 A 1/1993 Hillbish et al.
5,247,250 A * 9/1993 Rios ..... 324/754
5,942,908 A * 8/1999 Cain ..... 324/765
6,135,787 A 10/2000 Byrd et al.
6,206,728 B1 * 3/2001 Krehbiel et al. ..... 439/607
6,262,497 B1 * 7/2001 Muroi et al. ..... 307/139
6,276,944 B1 * 8/2001 Klatt ..... 439/76.1

OTHER PUBLICATIONS

9 Photographs of Shroud A97457-001 PRO. UL#1293 >STATCON<.
Intel Itanium 2 Processor Datasheet, Document No. 250945-002, Jun. 2003, p. i-viii, 1-1, and 4-1 to 4-6.
LNP Stat-Kon D-data provided by IDES, http://icatalog.ides.com/datasheet.asp?l=2300&M=7&SFP=4&FP=5&E=65224&..., Viewed on the World Wide Web on Feb. 24, 2004, p. 1-2.
LNP Stat-Kon and Stat-Loy Conductive and Statically Dissipative Compounds, http://www.lnp.com/LNP/Products/PElectricallyActive.html, Last Viewed on the World Wide Web Feb. 24, 2004, p. 1.
Stat-Kon DC-1002 EM FR BK8-115, http://icatalog.ides.com/datasheet.asp?l=2300&M=7&SFP=4&FP=5&E=65190&..., Last Viewed on the World Wide Web Feb. 24, 2004, p. 1-2.
Stat-Kon DC-1002 EM FR BK8-115, http://icatalog.ides.com/datasheet.asp?l=2300&M=7&SFP=4&FP=5&E=65190&, Last Viewed on the World Wide Web Feb. 24, 2004, p. 1-2.
Stat-Kon DC-1002 EM FR ECO, http://icatalog.ides.com/datasheet.asp?l=2300&M=7&SM=7&SFP=4&FP=5&E=71180&..., Last Viewed on the World Wide Web Feb. 24, 2004, p. 1.
Stat-Kon PDX-D-03633 CCS, http://icatalog.ides.com/datasheet.asp?l=2300&M=7&SM=7&SFP=4&FP=5&E-69983&..., Last Viewed on the World Wide Web Feb. 24, 2004, p. 1.

* cited by examiner

*Primary Examiner*—J. F. Duverne

(57) ABSTRACT

A pin shroud for a circuit board having a raised pin platform and a pin array projecting from the raised pin platform. A spacer extending from a side wall of the shroud engages a side of the raised pin platform, thereby accurately aligning the pin shroud with the pin platform.

29 Claims, 7 Drawing Sheets

PIN SHROUD

BACKGROUND OF INVENTION

Pin shrouds are often used during manufacture of electronic components for shielding pin fields from contact with other objects and for allowing sockets containing corresponding apertures to be blindly guided into mating engagement with the pin fields. One example of a prior pin shroud is found in connection with the Intel ITANIUM 2 processor package manufactured by Intel Corporation. This pin shroud aligns to slots or cut-outs in the perimeter of the package's circuit board, which locate the shroud on the circuit board for engagement with a mating socket.

SUMMARY

One disclosed embodiment of a shroud may comprise at least two side walls for positioning adjacent associated sides of a pin array, at least one cross-member for releasably connecting the shroud to a circuit board, the cross-member connecting the side walls to one another, and at least one spacer associated with a side wall, the spacer being structured to engage an associated side of a pin platform to thereby accurately align the shroud with the pin array on the circuit board. Another disclosed embodiment of a shroud may comprise at least one side wall arranged adjacent the pin array when the shroud is placed on a circuit board and at least one spacer extending from the at least one side wall for engaging a side of a raised pin platform to thereby accurately align the at least one side wall with the pin array.

DETAILED DESCRIPTION

A pin shroud disclosed herein may be used for protecting the pin array carried by a circuit board having a raised pin platform.

Figure 1:
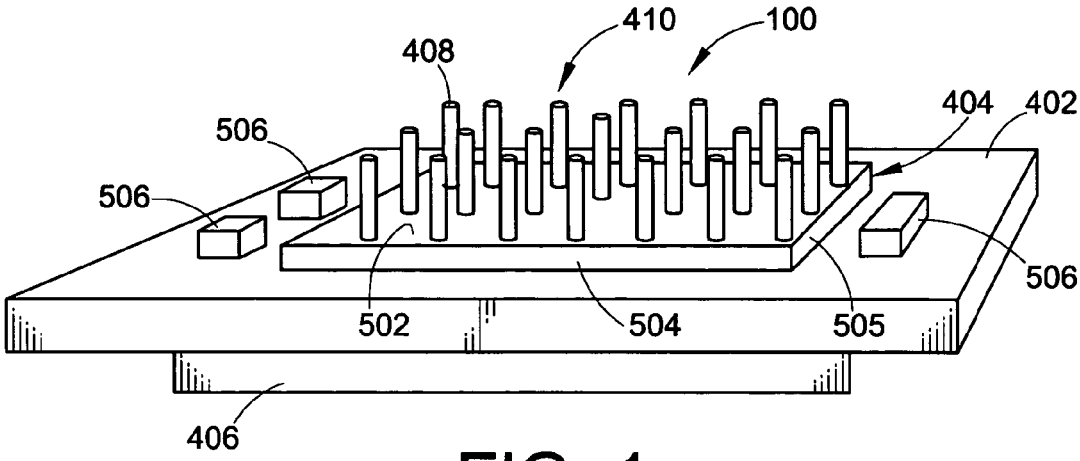
FIG. 1 is a perspective view illustrating one embodiment of a circuit board having an array of pins carried by a raised pin platform.

An example of such a circuit board is illustrated in FIG. 1, which shows circuit board 100 being formed from dielectric substrate 402 having a complex electronic device 406 such as a microprocessor, digital circuit or the like depending from its lower major surface. Supplemental electronic devices 506 such as resistors, capacitors, inductors and the like are carried by the upper major surface of the dielectric substrate, which also carries raised pin platform 404. Multiple pins 408 in the form of a pin array 410 are carried by and project from the upper major surface 502 of pin platform 404, with sides 504 and 505 of the platform extending between this upper major surface and dielectric substrate 402. In the particular embodiment shown, raised pin platform 404 is rectangular in configuration. However, any other shape can also be employed.

Figure 2:
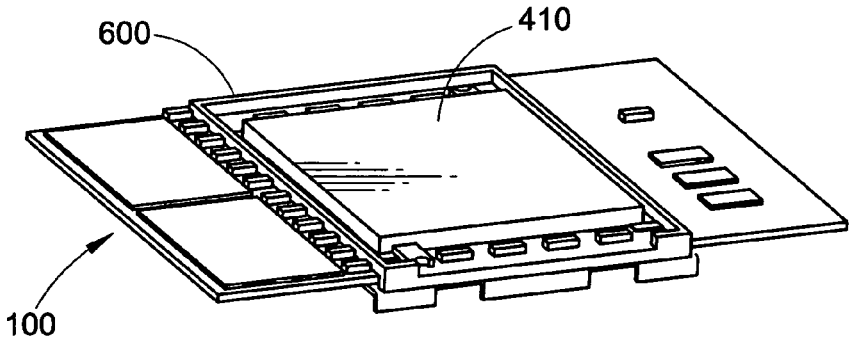
FIG. 2 is a perspective view of one embodiment of a pin shroud mounted on the circuit board of FIG. 1.

One embodiment of the pin shroud protects pins 408 in pin array 410 from contact with other devices and also facilitates mating engagement of a socket (not shown) containing an associated field of apertures with pin array 410. This is illustrated in FIG. 2, which shows pin shroud 600 being releasably attached to circuit board 100.

Figure 3:
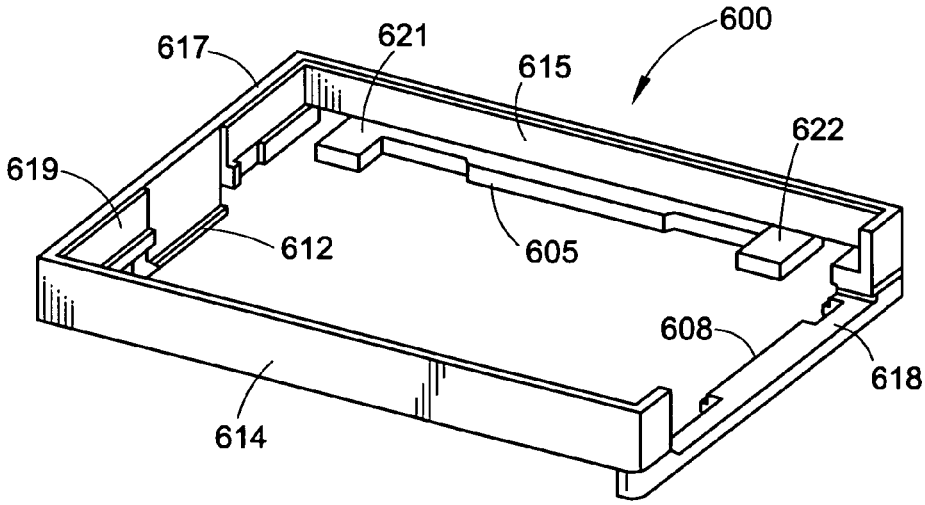
FIG. 3 is a perspective view of the pin shroud of FIG. 2.
Figure 4:
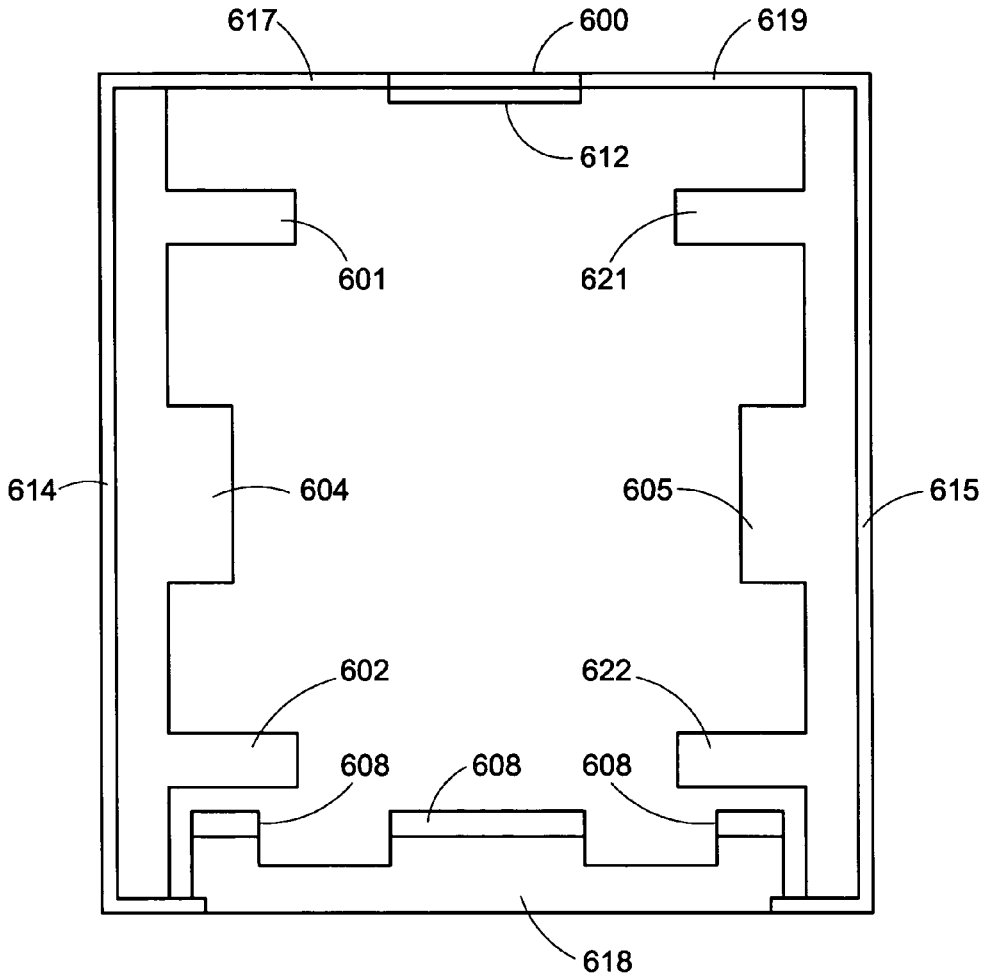
FIG. 4 is a plan view of the pin shroud of FIG. 2.
Figure 5:
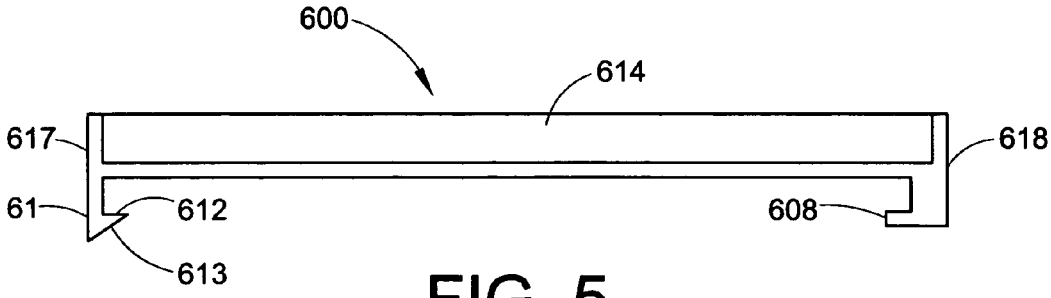
FIG. 5 is a side view of the pin shroud of FIG. 2.

As shown in FIGS. 3, 4 and 5, pin shroud 600 is formed from a single piece of an essentially rigid material such as molded plastic or the like which defines side walls 614 and 615 which are generally opposed to one another and arranged for positioning adjacent associated sides 414 and 415 (FIG. 6) of pin array 410. Side walls 614 and 615, which are typically at least as high as pins 408 and in some instances even higher, are connected to one another by opposed cross-members 617 and 618, which in the particular embodiment shown are arranged essentially perpendicular to side walls 614 and 615. In addition, cross-member 617 in the particular embodiment shown is shaped so as to form a third side wall 619 of shroud 600 for positioning adjacent or near associated side 620 (FIG. 6) of pin array 410. In contrast, cross-member 618 is a thin, flat section arranged generally parallel to the plane of dielectric substrate 402.

In order to releasably connect pin shroud 600 to circuit board 100, cross-members 617 and 618 are arranged to engage opposite edges 637 and 639 of dielectric substrate 402 of circuit board 100. (See, FIG. 6.) In the particular embodiment shown, shroud 600 is designed to be snap-fit to circuit board 100. For this purpose, a snap-fit connector in the form of a clip 612 (FIG. 5) is provided on a lower portion of cross-member 617, clip 612 being shaped to deflect slightly when shroud 600 is pushed onto circuit board 100. When lip 613 of clip 612 clears the lower major surface of dielectric substrate 402, clip 612 snaps back into its normal configuration, thereby causing lip 613 to securely hold cross-member 617 in place. When it is desired to remove shroud 600, clip 612 can be manually deflected until lip 613 clears edge 637 of dielectric substrate 402, at which time shroud 600 can be easily withdrawn.

In order to releasably connect cross-member 618 to circuit board 100, cross-member 618 can also be provided with a snap fit clip similar to clip 612, if desired. In the particular embodiment shown, however, cross-member 618 is provided with hook 608 for this purpose. (See, FIG. 5.) Hook 608 differs from clip 612 in that hook 608 is essentially rigid. Thus, slight lateral movement of shroud 600 will normally be necessary to connect cross-member 618 to dielectric substrate 402. This slight lateral movement allows the lip of hook 608 to clear edge 639 of the substrate. However, greater overall lateral stability is provided when hook 608 is used because it is rigid.

Figure 6:
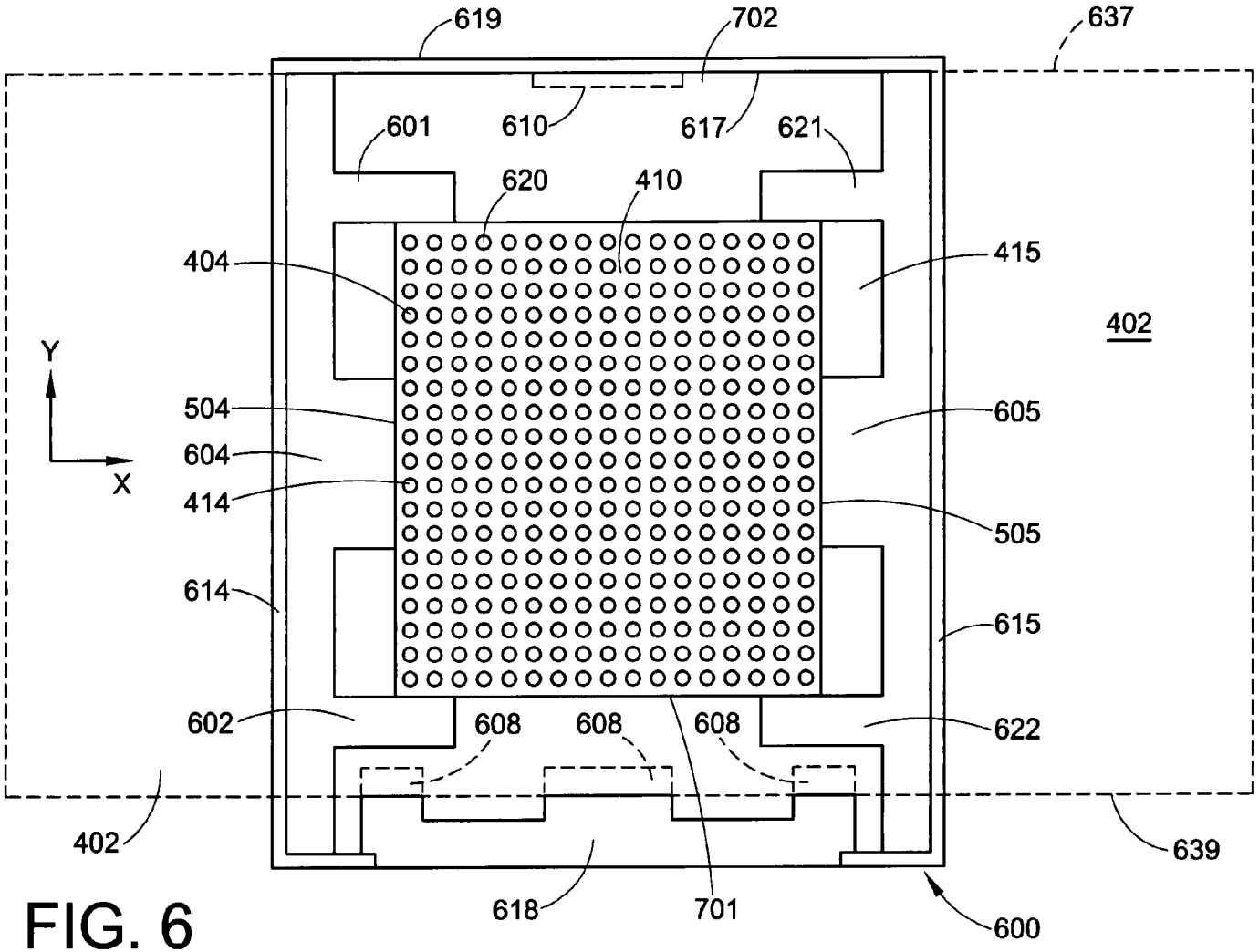
FIG. 6 is a plan view illustrating the pin shroud of FIG. 2 being mounted on the circuit board of FIG. 1.

In accordance with the present embodiment, at least one of the side walls of shroud 600 is provided with a spacer which is structured to engage an associated side of raised pin platform 404. This is illustrated in FIGS. 3, 4 and 6, which show primary spacers 604 and 605 projecting from lower portions of side walls 614 and 615, respectively. As shown in FIG. 6, primary spacer 604 is structured to engage left side 504 of raised pin platform 404, while primary spacer 605 is structured to engage right side 505 of the raised pin platform 404. This causes shroud 100 to accurately align with circuit board 100 in the transverse direction (i.e. in a direction transverse to side walls 614 and 615) as the two are being brought together for connection. In addition, this also causes shroud 600 to remain accurately aligned in the transverse direction even if subjected to significant shocks and other lateral forces as may happen, for example, during further handling of circuit board 100 such as may occur when additional electronic components are added and/or pins 408 are connected to an appropriate socket.

In the particular embodiment shown, side walls 614 and 615 are provided with additional spacers for aligning and securing shroud 600 in place in the longitudinal direction (i.e., in a direction generally perpendicular to the transverse direction). This is also shown in FIG. 6, which shows that secondary spacers 601 and 602 associated with side wall 614 are structure to engage leading sides 701 and 702 of raised pin platform 404, and secondary spacers 621 and 622 associated with side wall 615 are structure to also engage side 701 and 702 of raised pin platform 404. With this structure, proper alignment of shroud 600 with circuit board 100 in all directions is achieved. In addition, shroud 600 will remain properly aligned even if jarred other otherwise pushed from any direction.

Figure 7:
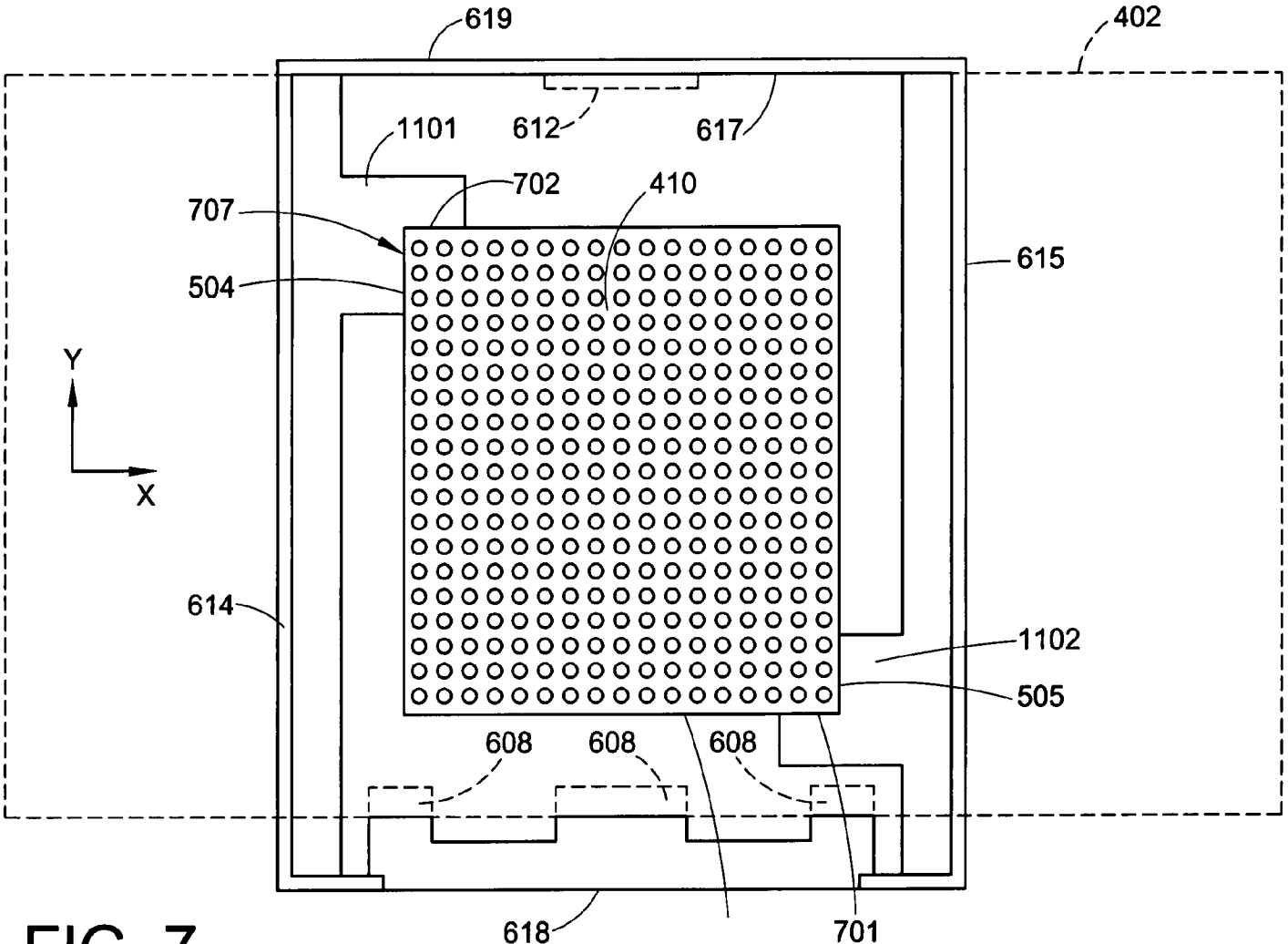
FIG. 7 is a plan view similar to FIG. 6 illustrating a second embodiment of a pin shroud.

A second embodiment of a shroud 700 is illustrated in FIG. 7. In this embodiment, primary spacers 604 and 605 and secondary spacers 601, 602, 621 and 622 of FIG. 6 are replaced with bilateral spacers 1101 and 1102. As shown in FIG. 7, bilateral spacer 1101 is shaped to engage both sides of corner 707 of raised pin platform 404, i.e. left side 504 and trailing side 702. Similarly, bilateral spacer 1102 is shaped to engage right side 505 and leading side 701 of the raised pin platform. With this design, only two spacers are necessary. This may simplify manufacturing procedures and allow additional electronic components to be closely spaced to raised pin platform 404. Of course, a bilateral spacer could be provided for each corner of raised pin platform 404. Similarly, a bilateral spacer could be provided for more than half but less than all of the corners of the raised pin platform. In addition, combinations of one or more bilateral spacers can be used together with one or more primary spacers, one or more secondary spacers, or both, depending on the particular design requirements involved.

Figure 8:
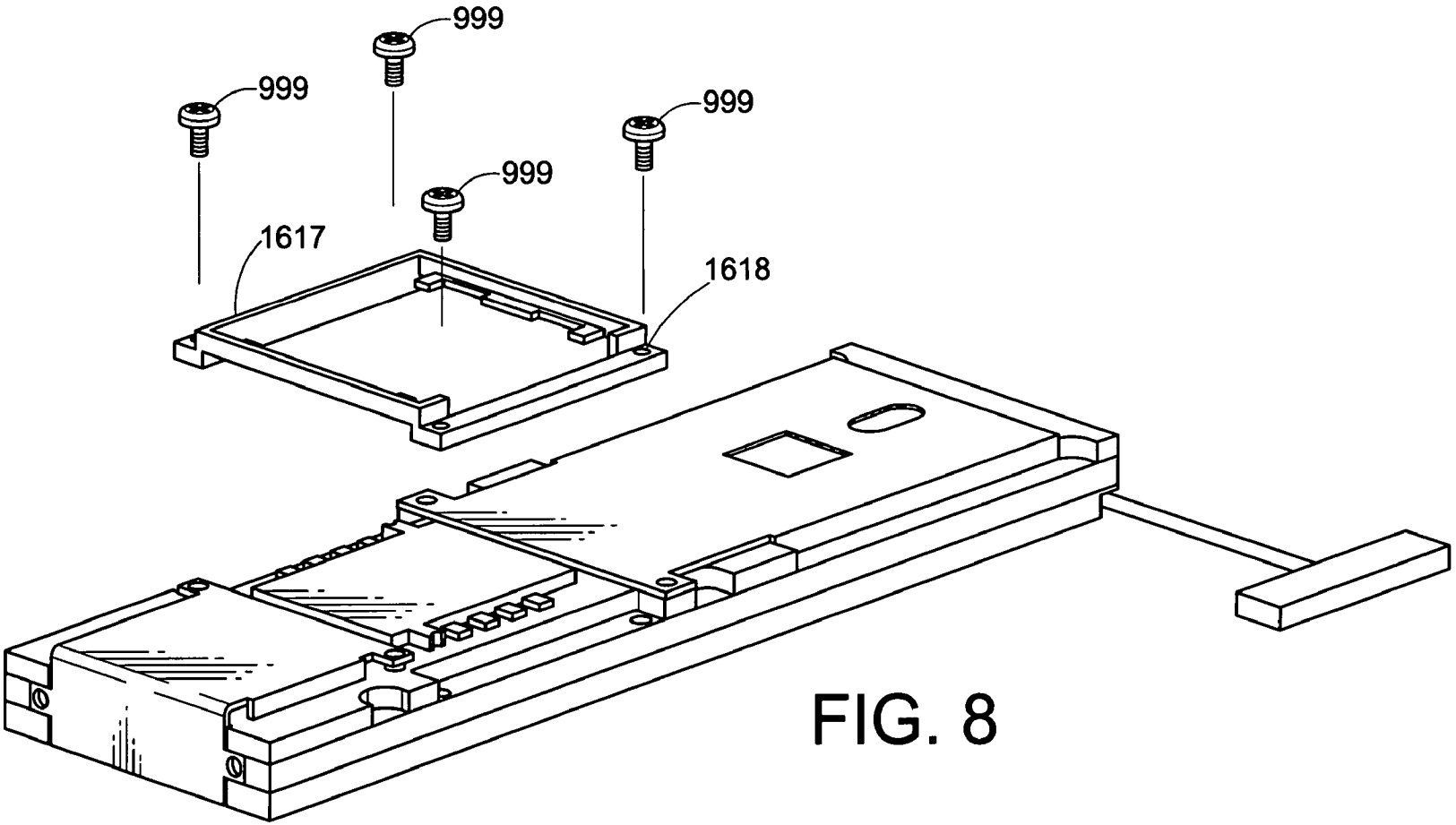
FIG. 8 is a perspective view similar to FIG. 2 illustrating a third embodiment of a pin shroud.
Figure 9:
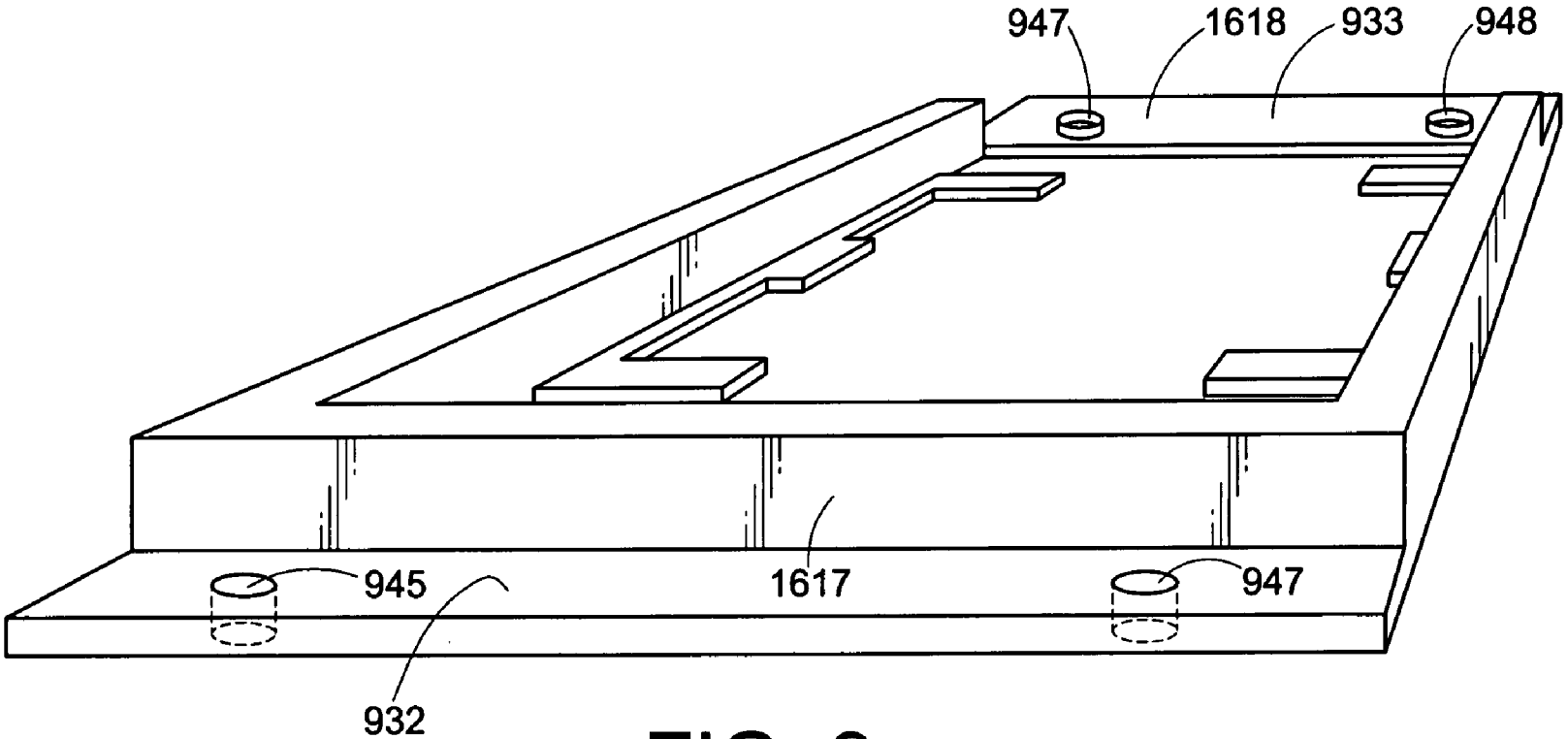
FIG. 9 is a perspective view of the pin shroud shown in FIG. 8.
Figure 10:
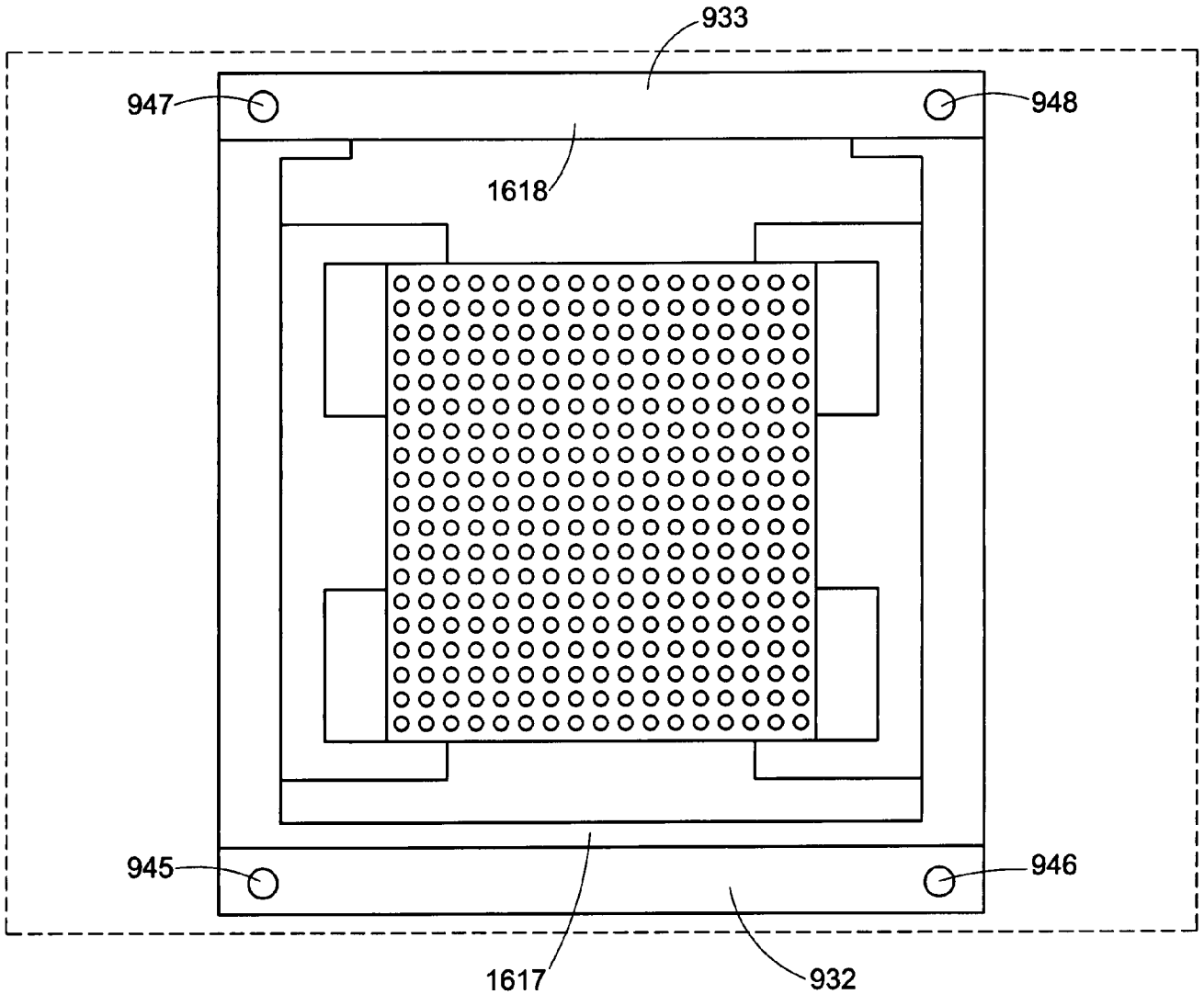
FIG. 10 is a plan view similar to FIG. 6 illustrating the pin shroud of FIGS. 8 and 9 being mounted on the circuit board of FIG. 1.

Still another embodiment of a shroud 800 is illustrated in FIGS. 8, 9 and 10. In this embodiment, cross-members 1617 and 1618 include flanges 932 and 933, respectively, for releasable attachment to circuit board 100. For this purpose, flange 932 defines apertures 945 and 946 while flange 933 defines apertures 947 and 948 for receiving screws 999 or other releasable fasteners for attaching shroud to dielectric substrate 402 of circuit board 100. If desired, these apertures can be made larger in cross-section than the fasteners. This allows adjustments in the position of the shroud with respect to the circuit board to be made, either manually or automatically through the action of the spacers as the shroud and circuit board are brought together, before these fasteners are tightened.

Other approaches for releasably attaching flanges 932 and 933 to dielectric substrate 402 of circuit board 100 could also be employed. For example, a separate clip which engages the upper surface of a flange and a lower surface of the dielectric substrate can be used in place of screws or other fasteners. In addition, the flanges may be attached to other portions of circuit board 100, in place of or in addition to dielectric substrate 402.

As indicated above, shroud 600 is normally made from a rigid plastic. Suitable examples are polycarbonate, polystyrene and ABS. Preferably the plastic exhibits static dissipation properties, which can normally be achieved by impregnating the plastic with an electrically conductive material such as carbon fibers, carbon powder and stainless steel fibers. Carbon fibers and stainless steel fibers also typically increase the rigidity of the plastic as well. In the particular embodiments described above, the shroud is made by molding a polycarbonate resin containing about 10 wt. % carbon fibers.

As indicated above in some embodiments of the shroud, corresponding sockets, i.e., sockets having a field of apertures corresponding to pin field, e.g. 410, can be blindly guided into mating engagement with this pin field without damage to the pins. For this purpose, it is desirable that the inner perimeter defined by the side walls of the shroud substantially match the corresponding outer perimeter of the socket. Thus, where the shroud defines two opposed side walls, these side walls should match the outer perimeter defined by the corresponding two opposed outer sides of the socket. Similarly, where the shroud defines three side walls, all three of these side walls should match the outer perimeter defined by the three corresponding outer sides of the socket. Moreover, the same approach can also be used in designing pin field covers that might be used to protect pins, e.g. 408, prior to final assembly.

Although only a few embodiments have been described above, it should be appreciated that many modifications can be made without departing from the spirit and scope of the invention. For example, the shroud can be permanently attached to circuit board, if desired. Similarly, the lower edges of the side walls of the shroud can be spaced above the dielectric substrate rather than being in contact with this dielectric substrate, as shown above. Additionally or alternatively, cutouts can be provided in these side walls, as well as in the cross-members, of the shroud to accommodate additional electronic components carried by the substrate. Similarly, all of the cross-members of the shroud can form side walls, like side wall 617 illustrated above, or all cross-members can form flat sections like side wall 618, if desired.

We claim:

1. A shroud for protecting an array of pins projecting from a raised pin platform carried on a circuit board, the shroud comprising a single piece body having at least two side walls, said side walls being positioned adjacent associated sides of the pin array when the shroud is installed on the circuit board, at least one cross-member releasably connecting the shroud to the circuit board, the cross-member connecting the side walls to one another, and at least one alignment spacer extending from one of said side walls said alignment spacer engages an associated side of the pin platform to thereby accurately align the shroud with the pin array.

2. The shroud of claim 1, wherein the shroud is formed from a single piece of essentially rigid material.

3. The shroud of claim 2, wherein the spacer is integral with a side wall.

4. The shroud of claim 3, wherein the shroud includes a pair of opposed side walls and further wherein each side wall of the opposed pair includes an integral spacer.

5. The shroud of claim 4, wherein the shroud includes a pair of opposed cross-members arranged generally perpendicular to the pair of opposed side walls of the shroud, the opposed cross-members being arranged for engaging opposite edges of the circuit board.

6. The shroud of claim 5, wherein one of the opposed cross members forms a third side wall of the shroud for positioning adjacent an associated side of the pin array, at least a portion of the third side wall being arranged to engage an edge of the circuit board.

7. The shroud of claim 6, wherein the other opposed cross member includes a snap-fit connector for engagement with the edge of the circuit board.

8. The shroud of claim 4, wherein the shroud includes a pair of opposed cross-members arranged generally perpendicular to the pair of opposed side walls of the shroud, the opposed cross-members having connectors for releasably connecting the shroud to the circuit board.

9. The shroud of claim 8, wherein the connectors comprise flanges attached to respective cross-members.

10. The shroud of claim 9, wherein the at least one of the cross-members forms a third side wall of the shroud for positioning adjacent an associated side of the pin array.

11. The shroud of claim 4, wherein at least one of the opposed side walls includes a primary spacer for engaging the corresponding side of the raised pin platform and a secondary spacer for engaging a different side of the raised pin platform.

12. The shroud of claim 11, wherein the secondary spacer is positioned to engage a side of the raised platform arranged at a right angle to the shroud side wall carrying the secondary spacer.

13. The shroud of claim 11, wherein an opposed side wall carries a bilateral spacer for engaging two different sides of the raised pin platform.

14. A shroud for a circuit board, the circuit board having a dielectric substrate, a raised pin platform on the dielectric substrate, and a pin array defined by multiple pins projecting from the pin platform, the shroud comprising:

at least one side wall arranged adjacent a side of the pin array when the shroud is placed on the circuit board, and at least one spacer extending transversely from the at least one side wall, said spacer transversely engages a side of the raised pin platform to thereby accurately align the at least one side wall with the pin array.

15. The shroud of claim 14, wherein the pin platform includes a pair of generally opposed platform sides, and further wherein the shroud includes a pair of generally opposed side walls, one opposed side wall being associated with each platform side, at least one spacer extending from each opposed side wall for engaging the associated side of the pin platform to thereby accurately align the shroud in placed on the circuit board.

16. An assembly comprising:

(a) a circuit board having a dielectric substrate, a raised pin platform attached to the dielectric substrate, and a pin array defined by multiple pins projecting from the pin platform, and (b) a single piece pin shroud comprising:

(1) at least one side wall arranged adjacent the pin array when the shroud is attached to the circuit board, and (2) at least one spacer extending transversely from said side wall and transversely engaging a side of the pin platform when the shroud is placed onto the circuit board to thereby accurately align the at least one side wall with the pin array.

17. The assembly of claim 16, wherein the pin platform defines multiple platform sides, and further wherein the shroud further comprises:

a first side wall adjacent to a first platform side and a first spacer extending from the first side wall for aligning the first side wall with the first platform side, and a second side wall adjacent to a second platform side and a second spacer extending from the second side wall for aligning the second side wall with the second platform side.

18. The subassembly of claim 17, wherein the shroud further comprises at least one connector for releasably connecting the shroud to the circuit board.

19. The assembly in claim 18, wherein the connector is a cross-member securing the first and second side walls together.

20. A shroud comprising:

a means for releasably connecting the shroud to a circuit board;

a means for aligning the shroud with a raised platform on the circuit board having an array of pins extending therefrom, the shroud being a single piece body and wherein the means for aligning the shroud comprises a walled perimeter having at least one tab extending laterally therefrom that engages the raised platform.

21. The shroud of claim 20 wherein the means for aligning the shroud comprises at least a partially walled perimeter having at least first and second tabs extending therefrom that engage the raised platform.

22. The shroud of claim 20 wherein the means for aligning the shroud comprises at least a partially walled perimeter having at least first, second and third tabs extending therefrom that engage the raised platform.

23. The shroud of claim 20 wherein the means for aligning the shroud comprises at least a partially walled perimeter having at least first, second, third and fourth tabs extending therefrom that engage the raised platform.

24. The shroud of claim 20 wherein the means for aligning the shroud comprises at least a partially walled perimeter having at least first, second, and third tabs extending therefrom that engage the raised platform and wherein the second tab is disposed between the first and third tabs.

25. A pin shroud for a pin array that extends from a raised platform of an electronic circuit rigidly mounted on a circuit board, comprising:

two side walls with each side wall having two opposite ends, and two cross-members, the first cross member connecting a first pair of said side wall ends and the second cross member connecting the other pair of said side wall ends, said connected side walls and cross members forming a generally rectangular single piece body that is adapted to attach directly to the circuit board;

at least one of said side walls having an alignment spacer extending there from;

whereby when the pin shroud is attached to the circuit board said side walls are positioned in an adjacent and surrounding relationship with associated sides of the pin array and said spacer engages a side of the rigidly mounted platform.

26. The pin shroud of claim 25 wherein each of said side walls and cross members have at least one alignment spacer extending integrally there from.

27. The pin shroud of claim 25 wherein said alignment spacer is a bilateral spacer that extends from both said at least one side wall and one of said cross members, said bilateral spacer engaging a corner of the platform.

28. The pin shroud of claim 27 comprising two bilateral spacers that engage respective corners of the platform.

29. The pin shroud of claim 28 wherein said two bilateral spacers engage diagonally opposite corners of the platform.

* * * * *